United States Patent [19]

Teltscher

[11] Patent Number: 4,754,693

[45] Date of Patent: Jul. 5, 1988

[54] VALVE

[75] Inventor: Rainer Teltscher, Waagkirchen, Fed. Rep. of Germany

[73] Assignee: Concordia Fluidtechnik GmbH, Stuttgart, Fed. Rep. of Germany

[21] Appl. No.: 31,786

[22] Filed: Mar. 30, 1987

[30] Foreign Application Priority Data

Apr. 23, 1986 [DE] Fed. Rep. of Germany ..... 3613747

[51] Int. Cl.[4] ..... F15B 11/08; F15B 13/04

[52] U.S. Cl. ..... 91/464; 91/459; 91/461; 137/596.18; 137/625.66

[58] Field of Search ..... 91/459, 461, 464; 137/596.14, 596.16, 596.18, 625.64, 625.68

[56] References Cited

U.S. PATENT DOCUMENTS

| | | | |
|---|---|---|---|
| 2,924,200 | 2/1960 | Hanna et al. | 91/464 |
| 3,062,192 | 11/1962 | Webb | 91/464 |
| 3,908,515 | 9/1975 | Johnson | 91/464 |
| 4,067,357 | 1/1978 | Ruchser | 137/596.16 |
| 4,154,262 | 5/1979 | Blume et al. | 91/464 |
| 4,506,700 | 3/1985 | Kramer | 91/464 |

*Primary Examiner*—Robert E. Garrett
*Assistant Examiner*—Thomas E. Denion
*Attorney, Agent, or Firm*—Learman & McCulloch

[57] ABSTRACT

The invention relates to a 5/3-valve, which contains two separately controllable control members which are arranged coaxially with one another in the valve housing, are movable independently of one another and each bear two sealing surfaces which in the two end positions of the relevant control member engage with an appertaining valve seat of the valve housing. Such a 5/3-valve is distinguished by a very simple construction, compactness and a long working life.

8 Claims, 2 Drawing Sheets

VALVE

The invention relates to a a pressure actuated valve of multiple connections.

BACKGROUND OF THE INVENTION

Valves of the type to which this invention pertains have five connections (one connection for the supply of pressure medium, two consuming device connections and two connections for the removal of pressure medium) and can take up three valving conditions. In one, the connection for the supply of pressure medium is coupled to two consuming device connections. In a second only to one consuming device is connected to the pressure supply, and in the third the pressure is coupled only to the other consuming device; in a modification in the first valving condition both consuming device connections are coupled to the associated connections for the removal of pressure medium, in the second condition only one consuming device is connected and in the third only the other consuming device is connected. Valves of this type can be designated as 5/3 valves, reflecting these five connections and three conditions of valving.

Previously known 5/3 valves are constructed as slide valves. In these the control arrangement which is movable within the valve housing contains an elongated valve body which has a plurality of control surfaces and produces the aforementioned connections in the three valving positions. The essential disadvantage of these known 5/3-valves which are constructed as slide valves lies in their high production costs and their comparatively short working life.

SUMMARY OF THE INVENTION

The object of the invention, therefore, is to develop a 5/3-valve which is distinguished by a particularly simple construction, a long working life, and compactness.

First of all a slide-seat valve is produced according to the invention as a 5/3-valve. It is distinguished by a particularly simple and compact construction, and in this connection it is of particular significance for economic manufacture that to a large extent basic elements of known 3/2-valves can be used. A further advantage is that it has a longer working life than slide valves which can be achieved by the construction of the valve according to the invention as a slide-seat valve.

THE DRAWINGS

The invention is illustrated by way of example in the drawings.

FIGS. 1 and 2 each show a section through an embodiment of the valve according to the invention.

DETAILED DESCRIPTION

Figure 1:
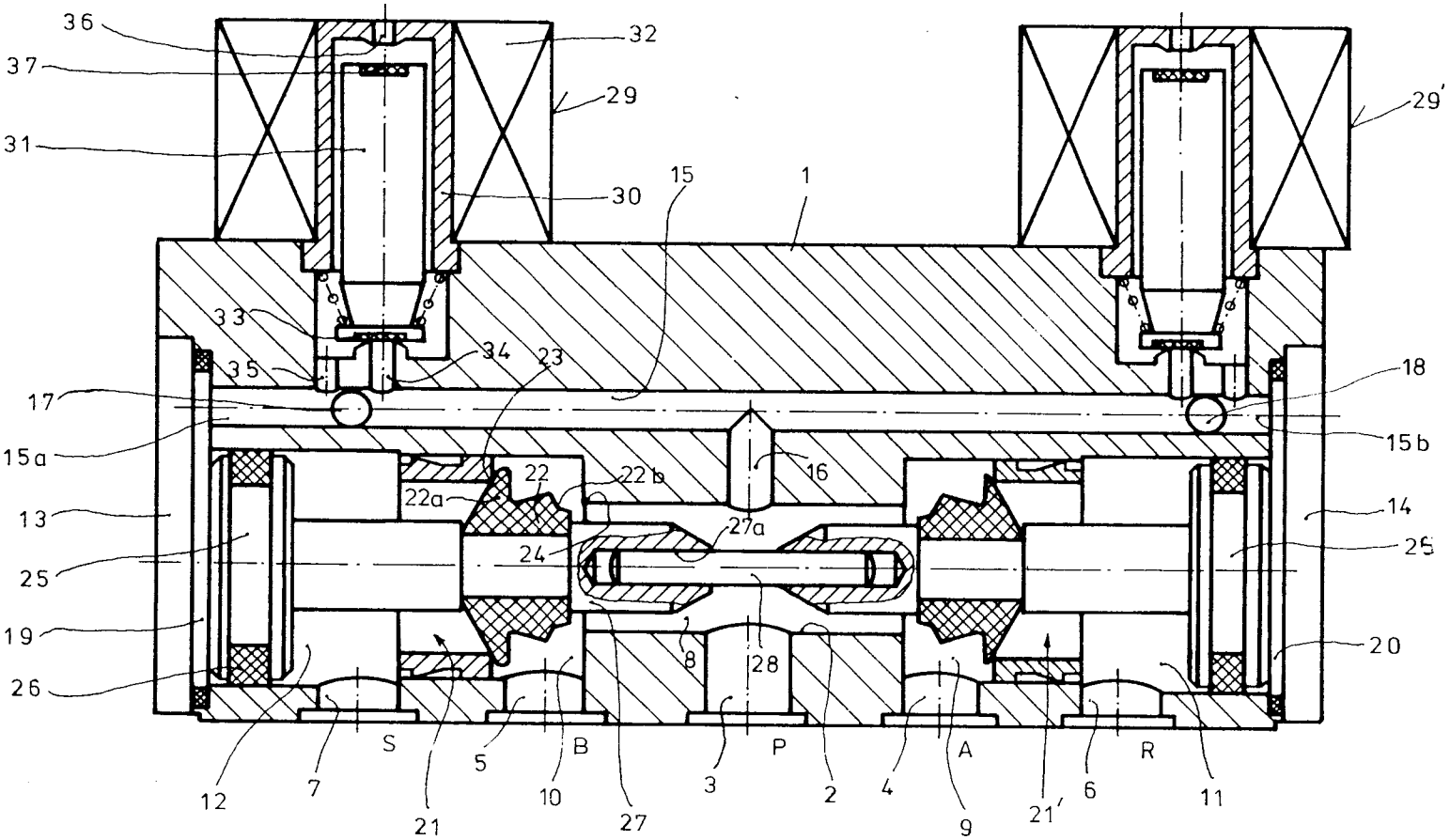

The valve housing 1 of the 5/3-valve shown in FIG. 1 contains an elongate, axially extending passage at the center of which is a central bore 2 into which the transverse bores or ports 3, 4, 5, 6 and 7 open. The transverse bore 3 forms a connection P for the supply of pressure medium. The transverse bores 4 and 5 constitute the consuming device connections A and B and the transverse bores 6 and 7 constitute exhaust connections R and S for the removal of pressure medium. The axial passage has chambers at opposite ends of the bore 2 into which the transverse bores 3 to 7 open and are designated by the numeral 8 to 12.

The axial passage is closed at both ends by covers 13 or 14. A further bore 15 which extends in the longitudinal direction of the valve housing 1 is connected by a port 16 to the chamber 8 and closed near each end by a ball 17, 18. The regions 15*a*, 15*b* of the bore 15 located outside the balls 17, 18 open into chambers 19, 20.

Two control valve members 21, 21' are movably accommodated in the passage at opposite ends of the bore 2 of the valve housing 1. These valve members are of identical construction, so only one valve member 21 will be described in detail below. The corresponding parts of the control member 21' are designated by the same reference numerals modified by prime indicia.

The control valve member 21 bears a sealing element 22 of integral construction which forms two sealing surfaces 22*a* 22*b*. The sealing surface 22*a* is engageable with a valve seat 23 and the sealing element 22*b* is engageable with a valve seat 24. The two valve seats straddle the port 5.

At the outer end the control valve member 21 is connected to a control piston 25 which bears a sealing element 26 on its periphery and is guided in the outer region of the axial passage so as to be slidably movable.

The inner end 27 of the control member 21 is provided with a bore 27*a* in which an aligning guide pin 28 is be slidably movable. At their inner ends which face one another the two control valve members 21, 21' are connected so as to be slidably movable on the guide pin 28, so that they can be moved independently of one another.

Two servo elements 29, 29' are also provided which are of identical construction so that the description of the servo element 29 is sufficient. Here also corresponding parts of the servo element 29' are designated by the same reference numerals modified by prime indicia.

The servo element 29 is a 3/2-valve with three connections and two positions. It contains in a valve housing 30 a movable valve body 31 which is movable by means of a magnetic coil 32 between an upper and a lower switch position. In the lower switch position shown in FIG. 1 the valve body closes a bore 34 connected to the bore 15 with a sealing element 33, whilst the connection between a bore 35 adjoining the region 15*a* and an air-venting bore 36 is opened. On the other hand in the upper switch position a sealing element 37 closes the air-venting bore 36, whilst the connection between the bores 34 and 35 is freed.

The 5/3-valve according to FIG. 1 functions as follows (it is assumed that compressed air is used as the pressure medium):

In the illustrated normal position the two servo elements 29, and 29'0 are not actuated. Consequently air is vented from the chambers 19, 20 via the bores 35, 36 and 35', 36'. The air pressure in the chambers 8, 9 and 10 pushes the two control valve members 21, 21' outwards so that the sealing surfaces 22*a*, 22*a'* a rest on the valve seats 23, 23' and seal them. Thus the connection P for the supply of pressure medium is coupled to the two consuming device connections A and B.

If, for example, the servo elements 29 is now actuated so that the air-venting bore 36 is closed and the connection between the bores 34 and 35 is made then compressed air passes from the central chamber 8 into the chamber 19 and thus pushes the control valve member 21 via the control piston 25 towards the right so that the sealing surface 22*b* rests on the valve seat 24. Thus the consuming device connection B is now shut off from the connection P for the supply of pressure medium and coupled to the associated connection 5 for the removal of pressure medium.

If the servo element 29′ is actuated, then the control member 21′ is moved towards the left in a corresponding manner by the control piston 25′ so that the consuming device connection A is shut off from the connection P for the supply of pressure medium and coupled to the connection R for the removal of pressure medium.

Thus the two control valve members 21, 21′ which are arranged axially with one another in the valve housing 1 can be controlled separately by the servo elements 29, 29′ and can be moved independently of one another between two end positions. In this way the control valve member 21 controls the coupling of the consuming device connection B and the control valve member 21′ controls the coupling of the consuming device connection A.

Figure 2:
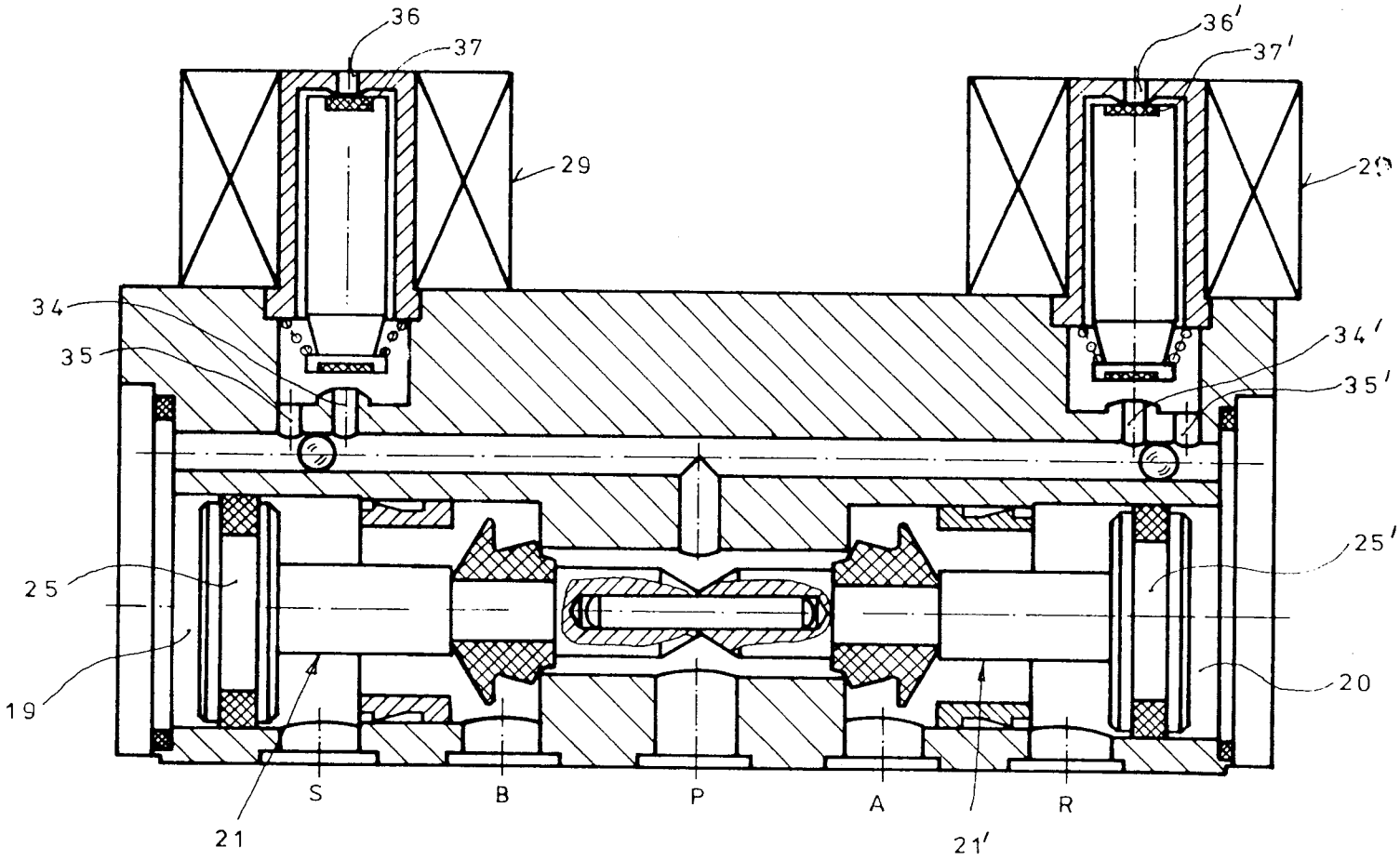

In the modification illustrated in FIG. 2 the same components are designated by the same reference numerals as in FIG. 1.

In FIG. 2 the normal position of the servo elements 29, 29′ and accordingly also the normal position of the control valve members 21, 21′ differ from those in the modification of FIG. 1. In the normal position illustrated in FIG. 2 the air-venting bores 35, 36′ of the servo elements 29, 29′ are closed by the sealing elements 37, 37′, while the bores 34, 35 and 34′, 35′ are connected to one another. As a result, the chambers 19, 20 are supplied with air so that the control pistons 25, 25′ push the control valve members 21, 21′ inwards. In this normal position in which the servo elements 29, 29′ are not actuated the control valve members 21, 21′ therefore free the coupling between the two consuming device connections A and B and the appertaining connections R and S for the removal of pressure medium.

If for example the servo element 29 is actuated, then the control valve member 21 is guided towards the left so that the consuming device connection B is coupled to the connection P for the supply of pressure medium. In a corresponding manner, when the servo element 29′ is actuated the coupling between the consuming device connection A and the connection P for the supply of pressure medium is made.

It should also be pointed out that the supply of pressure medium to the chambers 19, 20 for actuation of the control pistons 25, 25′ does not have to take place via the illustrated servo elements 29 and 29′, but can also come from another controllable source of pressure medium.

The normal position of the two servo elements 29, 29′ occurs for example when the magnetic coil 32 is supplied with current. Actuation or switching over of the servo element then takes place by means of a break in the current.

What is claimed is:

1. A multiple connection pressure control valve housing having a central connection for supply of pressure medium, a consuming device connection at each side of said central connection, and a connection at each side of said central pressure supply connection for removal of pressure medium; a control assembly within said valve housing in control relationship with said connections, said control assembly including two control members carried coaxially in opposing relationship in said valve housing and positioned one at each side of said central connection, each of said control members being capable of independent endwise movement between two end positions; each of said control members including a pair of opposing sealing surfaces spaced along its axis, valve seats in said housing between the pressure supply and each consuming device connection, each cooperating with a corresponding first sealing surface of each such pair, and valve seats in said housing between each consuming device and the adjacent pressure removal connection, each cooperating with a corresponding second sealing surface of each such pair, said control assembly further including means for independently actuating each of said control members between its end positions for coupling of each respective consuming device connection either to the central pressure supply connection or to the associated pressure removal connection.

2. A valve according to claim 1 wherein said two control members include an alignment member in sliding relationship with each other at their inner opposing ends which face one another.

3. A valve according to claim 1 wherein each of said two control member includes an actuating piston at its outer end, each of said pistons being guided in said valve housing.

4. A valve according to claim 1 wherein the two opposed sealing surfaces of each control member are formed by a common sealing element of integral construction.

5. A valve according to claim 3 wherein a valve with three connections and two positions is associated with each of the two control members as a servo element for control thereof.

6. A valve according to claim 5 wherein in the normal position of the control members, in which the servo elements are not actuated, the connection for the supply of pressure medium is coupled to the two consuming device connections.

7. A valve according to claim 5 wherein in the normal position of the control members, in which the servo elements are not actuated, the two consuming device connections are coupled to the appertaining connections for the removal of pressure medium.

8. A multiple connection pressure control valve construction comprising a housing having an elongate passage therein; a pressure medium connection in communication with said passage between its ends; a first pair of inboard and outboard ports spaced axially of said passage and in communication therewith between said pressure medium connection and one end of said passage; a second pair of inboard and outboard ports spaced axially of said passage and in communication therewith between said pressure medium connection and the opposite end of said passage, one port of each of said pair comprising a consuming device connection and the other port of each pair comprising an exhaust connection; means forming a pair of axially spaced valve seats in said passage on opposite sides of said pressure medium connection, the valve seats of each pair thereof straddling the associated inboard port; a pair of valve members accommodated in said passage for movements axially thereof, one of said valve members occupying a position between the valve seats of one pair of said seats and the other of said valve members occupying a position between the valve seats of the other pair of seats, each of said valve members having a pair of sealing surfaces one of which is engageable with one valve seat of the associated pair of seats and the other of which is engageable with the valve seat of the other valve seat of said associated pair of seats; and means operable to effect axial movements of each of said valve members independently of the other between sealing engagement with each of its respective valve seats.

* * * * *